US005246068A

United States Patent [19]

Besson

[11] Patent Number: 5,246,068

[45] Date of Patent: Sep. 21, 1993

[54] APPARATUS FOR REMOVING A WELLHEAD COVER FROM A WELL

[76] Inventor: Ronald Besson, 28 Riverview Dr., Norwalk, Conn. 06850

[21] Appl. No.: 895,894

[22] Filed: Jun. 9, 1992

Related U.S. Application Data

[63] Continuation-in-part of Ser. No. 713,801, Jun. 12, 1991, abandoned.

[51] Int. Cl.[5] ..... E21B 17/12

[52] U.S. Cl. ..... 166/85; 294/90; 294/81.5

[58] Field of Search ..... 166/85, 93, 94, 377; 294/90, 81.5, 81.56

[56] References Cited

U.S. PATENT DOCUMENTS

| | | | |
|---|---|---|---|
| 2,517,870 | 8/1950 | Gump | 166/85 X |
| 3,211,240 | 10/1965 | Smitter et al. | 294/90 X |
| 3,645,328 | 2/1972 | Greene, Jr. | 166/85 |
| 4,951,989 | 8/1990 | Goodin | 294/90 |

*Primary Examiner*—William P. Neuder
*Attorney, Agent, or Firm*—Parmelee, Bollinger & Bramblett

[57] ABSTRACT

A wellhead puller is positioned in a support on an excavated well exposing a wellhead cover having mounting nuts positioned thereon. A threaded shaft having first and second ends is mounted for vertical movement in the support with the first end extending above the support and the second end which contains the puller extending downwardly near the wellhead cover. The puller has a cross piece mounted thereon with two rigid legs extended downwardly therefrom, each leg of which has a right angled foot extending therefrom adapted to fit under and engage a loosened wellhead cover. A tightener is mounted on the first end of the threaded shaft above the support for elevating the shaft and the puller attached thereto for lifting the wellhead cover from the top of the well. The right angled feet are slotted to fit under loosened mounting nuts of the wellhead cover or are trapezoidal to engage the underside of a loosened cover.

3 Claims, 2 Drawing Sheets

APPARATUS FOR REMOVING A WELLHEAD COVER FROM A WELL

This application is a continuation-in-part of co-pending application Ser. No. 07/713,801 filed June 12, 1991, now abandoned.

BACKGROUND OF THE INVENTION

This invention relates to a wellhead cover puller, and more particularly to an apparatus for removing a wellhead cover from the top of a well.

Many suburban as well as rural areas have no city or piped water supply, and accordingly rely on artisan wells for providing the necessary water. The wells are drilled and usually either above ground pumps or submersible pumps are utilized to deliver the water where required. The well bore from which piping extends is covered by a wellhead cover which in turn is generally buried under 3 to 6 feet of earth. Accordingly, when the well needs servicing, for example, repairing a submersible pump, unclogging lines or generally gaining access to the well bore, the wellhead cover must be exposed by excavation. Due to the very nature of the cover corrosion may set in making it difficult to remove the cover. Once the wellhead cover is exposed the workmen must get down into the excavation and hammer the wellhead cover to loosen it which may be both time consuming and difficult. Since the opening of the excavation is not too large, there is little room to swing an implement for loosening the head cover, and furthermore its very difficult to hold something like a hammer down in a 3 to 6 foot opening and to obtain the necessary leverage and room to supply a blow or a multiply bunch of blows which will loosen the wellhead cover so that it can be removed and the well serviced. In addition, no convenient tool or device is available to engage and assist in removing the cover once the cover has been exposed.

SUMMARY OF THE INVENTION

Accordingly it is an object of this invention to provide a new and improved method and apparatus for removing a wellhead cover from a well bore.

Another object of this invention is to provide a new and improved method and apparatus for removing a wellhead cover which is simple to install and operate.

Yet another object of the present invention is to provide a new and improved method and apparatus for removing a wellhead cover which is less time consuming and accordingly less expensive than the brute methods used in the past.

In carrying out this invention in one illustrative embodiment thereof, a wellhead cover puller adapted to remove a wellhead cover from a well is provided with a support which is adapted to be positioned on a excavated well exposing a wellhead cover. A threaded shaft having first and second ends mounted for vertical movement in the support is provided with the first end extending above the support and the second adapted to extend downwardly in the well near the wellhead cover. A puller having a cross piece is mounted on the second end of the shaft and two rigid legs extend downwardly therefrom each leg of which has an angled foot extending are right angles therefrom adapted to engage the wellhead cover. Moveable means are mounted on the first end of the threaded shaft over the support for elevating the shaft and the puller attached thereto for lifting said wellhead cover off of the well.

BRIEF DESCRIPTION OF THE DRAWINGS

The invention, together with further objects, aspects, features and objects thereof will be more clearly understood from the following description taken in connection with the accompanying drawings.

DESCRIPTION OF THE PREFERRED EMBODIMENTS

Figure 1:
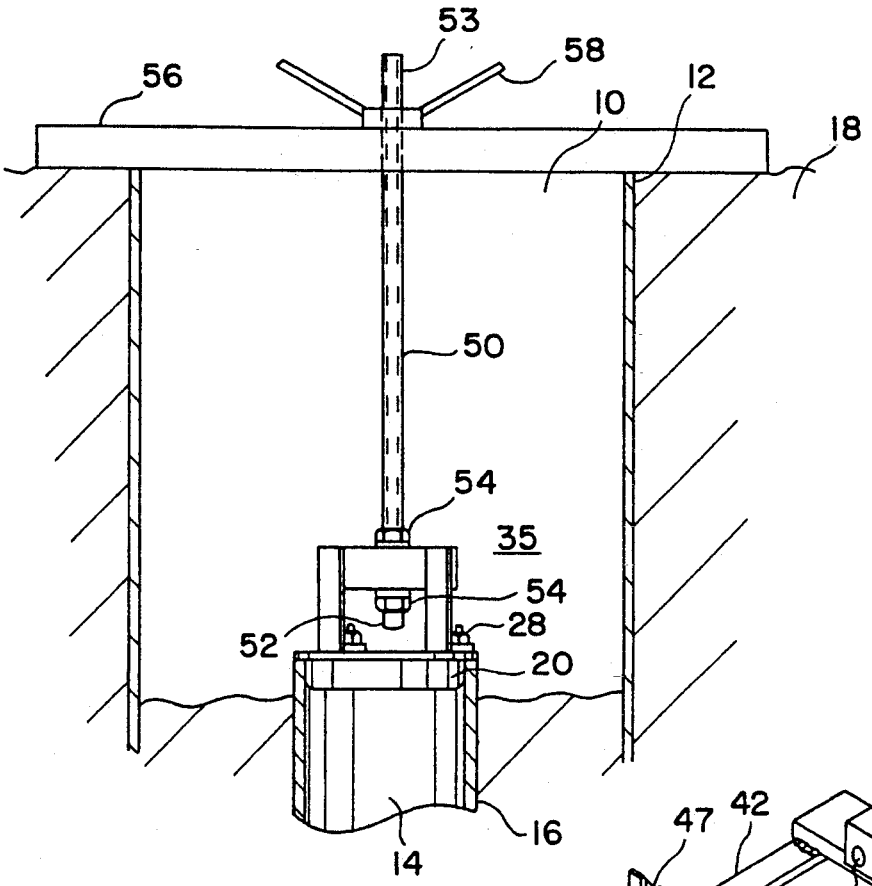
FIG. 1 illustrates the wellhead cover puller apparatus mounted on a well whose cover has been exposed and with the puller attached thereto in accordance with the present invention.

Referring now to FIG. 1, a well excavation (10) which may or may not be enclosed by a cylindrical wall (12) exposes a well bore (14) having a casing (16) which is covered or topped by a wellhead cover (20). The cylindrical wall (12) is surrounded by the earth (18) which prior to excavation of the well (10) would also cover the wellhead cover (20). Generally speaking, the wellhead cover may be approximately 3 to 6 feet from the drop of the ground (18).

Figure 3:
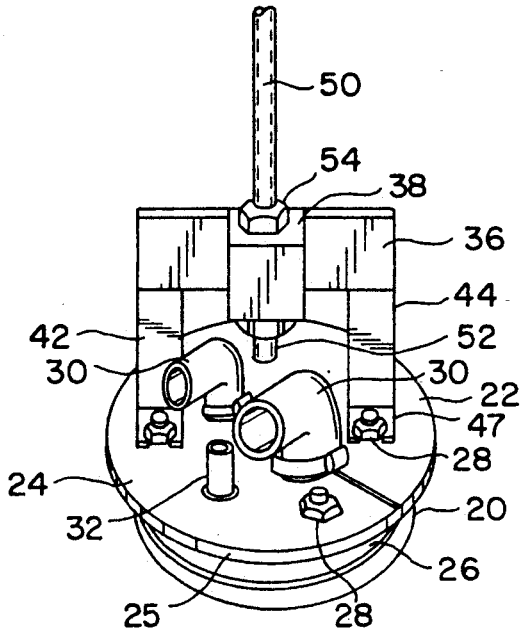
FIG. 3 is a perspective view of the puller apparatus shown in FIG. 2 mounted on a split-headed wellhead cover in position for removal thereof by the puller apparatus in accordance with the present invention.

A will be seen in FIG. 3 the wellhead cover (20) is comprised of a split-head having halves (22) and (24) which are bolted by nuts (28) to a wellhead cover body (26). The wellhead cover (20) also includes conduits (30) for communicating with submersible pumps and/or water in the well. A vent (32) is also provided in the wellhead cover (20).

As well best be seen in FIG. 2 a puller, referred to generally with the reference numeral (35), contains a cross piece (36) having a mounting block (38) with a channel (40) therein for receiving and mounting the puller (35) on a threaded shaft (50) as will be explained hereinafter. A pair of spaced parallel legs (42) and (44) extend downwardly from opposite ends of the cross-piece (36). Right angled slotted feet (46) and (48) extend outwardly from the ends of rigid legs (42) and (44), respectively. Gussets (47) are mounted on the feet (46) and legs (42) to provide added support for the slotted feet (46).

Figure 2:
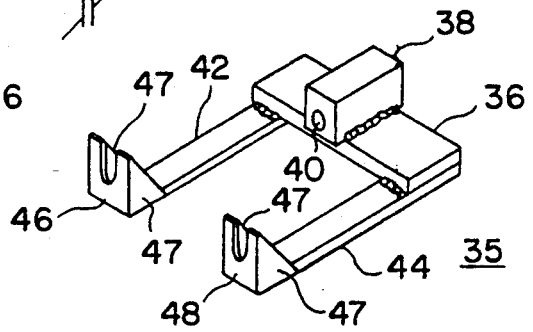
FIG. 2 is a perspective view of a portion of the puller apparatus illustrated in FIG. 1.

As will best be seen in FIGS. 1 and 2, the puller (35) is mounted on the lower end (52) of a threaded shaft (50) by nuts (54). The threaded shaft (50) is positioned in a support (56) with the upper end (53) extending upwardly through and out of the support (56). Means are provided for elevating the shaft (50) with the puller attached thereto in the form of a wing nut (58). The support (56) may be any type of brace such as a Unistrut which has a plurality of holes therein in which the shaft (50) can be mounted or any other form of support in which the shaft can extend and be elevated and ultimately supported thereby.

In operation, the well (10) is first excavated to expose the wellhead cover (20). At least two nuts (28) on opposite sides of the split wellhead cover (20) thus one in half

(22) and the other in half (24) are loosened through the well excavation (10). The slotted feet (46) and (48) of the puller (35) are then slipped or tapped under the loosened nuts (28) to attach the puller (35) on top of the split wellhead cover (20). The threaded shaft to which the puller (35) is attached is then positioned through a support (56) which has been placed on the ground (18) across the well excavation (10) to provide support for the puller apparatus. Wing nut (58) is then applied to the top end (53) of the threaded shaft (50) for providing a means of elevating the shaft through the support (56) by tightening the wing nut (58) on the support (56). The support (56) may be placed directly on the ground particularly if a cylindrical wall (12) has been sunk in the ground for the well opening.

However, concrete blocks or other forms of support could be placed under the support (56) away from the excavation opening in order to provide added support and stability for the puller apparatus of this invention. If necessary once the puller (35) is attached to the split wellhead cover (20) the cover may be tapped to loosen it for the pulling operation.

All the wellhead covers do not have standard separations between mounting nuts so if desired, the separation between the parallel legs (42) and (44) could be made adjustable. However, as an alternative, reference is made to FIGS. 4–6 which illustrates and another embodiment of a puller which may be used for the puller (35) in apparatus illustrated in FIGS. 1 and 3.

Figure 4:
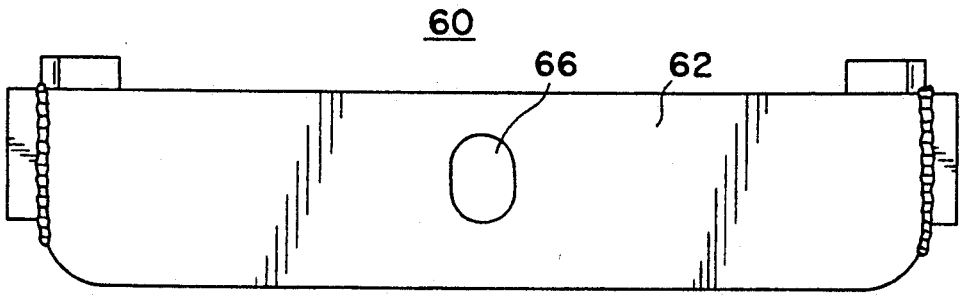
FIG. 4 is a top view of another embodiment of the puller in accordance with the present invention.
Figure 5:
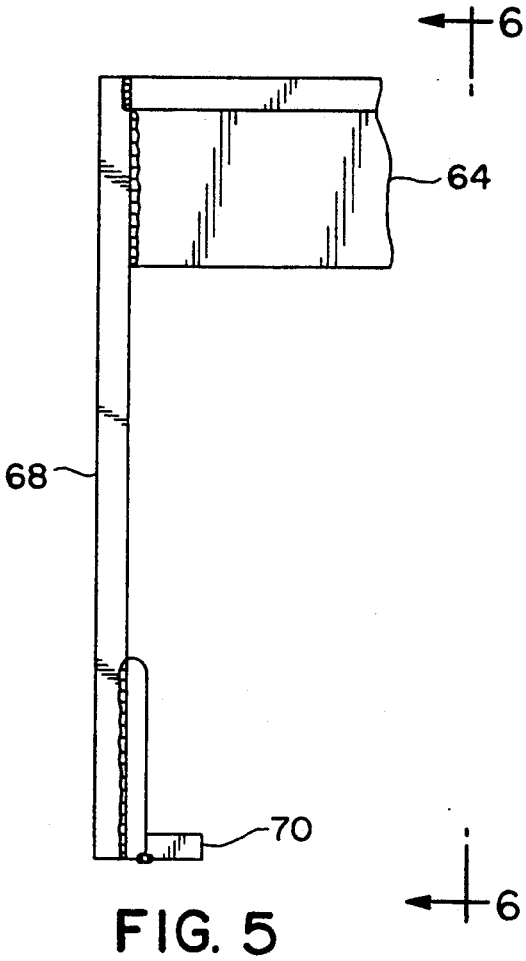
FIG. 5 is a partial front view of the puller shown in FIG. 4.
Figure 6:
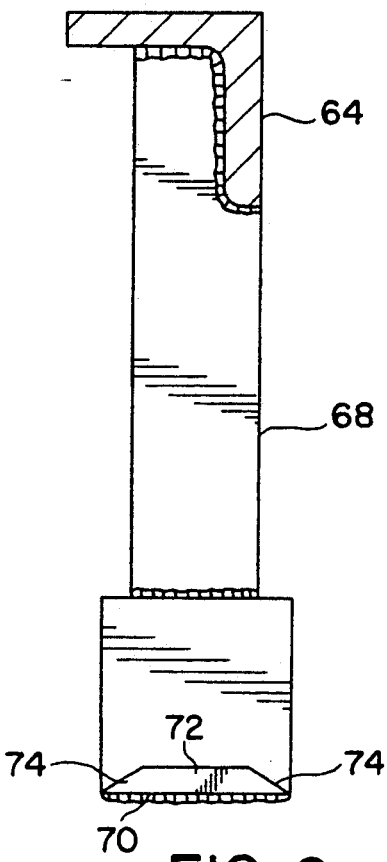
FIG. 6 is a cross sectional view taken along line 6—6 of Fig. 5.

The puller (60) as shown in FIGS. 4–6 includes a top plate (62) of a bracket (64) having a slot (66) therein to accommodate receipt of shaft (50) therein. The puller (60) has downwarding extending parallel legs (60) with right angled feet (70) extending therefrom. The right angled feet (70) extend toward each other from the parallel legs (68) and have trapezoidal configurations (72) as is best seen in FIG. 6. The trapezoids (72) have ramps (74) thereon which are adapted to wedge on the underside of a wellhead cover flange (25). The trapezoidal feet are symmetrical so the ramps (74) may be slipped from either side of the feet (70) under the flange (25).

The operation or use of the puller (60) is the same as that of the puller (35) with the exception of the engagement with the wellhead cover (20). In the embodiment of FIGS. 4–6, the wellhead cover (20) is loosened by tapping and the feet (70) of the puller (60) are wedged or slipped under wellhead the flange (25) via the ramps (74). If necessary, additional tapping of the puller (60) is used for wedging the puller under the flange (25). Once engagement is made, the removal is accomplished in the manner described in connection with the embodiment of FIG. 1.

Accordingly, a very simple structure has been provided for dealing with the problem of reaching through an excavational opening of varying depth to get to a wellhead cover and remove it. The puller of the present invention is easy to operate, is not mechanically complex, and aids in shortening the task which could become a very frustrating time consuming effort in removal of a wellhead cover from a well.

Since other changes and modifications very to fit particular operating requirements and environments will be apparent to those skilled in the art, the invention is not considered limited to the examples chosen for purposes of illustration, and includes all changes and modifications which do not constitute a departure from the true spirit and scope of this invention as claimed in the following claims and equivalents thereto.

What is claimed is:

1. A wellhead cover puller adapted to remove a wellhead cover from a well to expose the internal bore of a well comprising:

a support adapted to be positioned on an excavated well exposing a wellhead cover having spaced mounting nuts positioned thereon;

a threaded shaft having first and second ends mounted for vertical movement in said support, said first end extending above said support and said second end adapted to extend downwardly in said well near said wellhead cover;

a puller having a crosspiece mounted on said second end of said shaft and two rigid parallel legs extending downwardly therefrom;

each leg having a right angled foot extending therefrom adapted to fit under and engage said wellhead cover; and moveable means mounted on said first end of said threaded shaft over said support for elevating said shaft and said puller attached thereto for lifting said wellhead cover off the well.

2. The wellhead cover puller as claimed in claim 1 wherein said right angled feet each have a similar slot therein adapted to fit under and engage loosened spaced mounting nuts on said wellhead cover.

3. The wellhead cover puller as claimed in claim 1 wherein said right angled feet face each other from said legs and have a trapezoidal shape adapted to engage the underside of said wellhead cover from either side of the trapezoid.

* * * * *